United States Patent [19]

Pfarrwaller

[11] Patent Number: 4,846,232

[45] Date of Patent: Jul. 11, 1989

[54] GRIPPER PROJECTILE

[75] Inventor: Erwin Pfarrwaller, Winterthur, Switzerland

[73] Assignee: Sulzer Brothers Limited, Winterthur, Switzerland

[21] Appl. No.: 195,688

[22] Filed: May 18, 1988

[30] Foreign Application Data

Jun. 9, 1987 [CH] Switzerland ..... 2166/87

[51] Int. Cl.[4] ..... D03J 5/06

[52] U.S. Cl. ..... 139/439; 139/196.2

[58] Field of Search ..... 139/196.1, 196.2, 437, 139/438, 439

[56] References Cited

FOREIGN PATENT DOCUMENTS 950778 9/1956 Fed. Rep. of Germany .
2238998 1/1974 Fed. Rep. of Germany .
2641248 3/1978 Fed. Rep. of Germany .
1480027 5/1967 France .
47410 10/1977 U.S.S.R. ..... 139/196.2

*Primary Examiner*—Henry S. Jaudon
*Attorney, Agent, or Firm*—Kenyon & Kenyon

[57] ABSTRACT

The plastic projectile with an associated projectile opener has a projectile clip having arcuate parts. The projectile opener exerts forces both transversely and lengthwise of the picking direction on the arcuate parts of the clip for simultaneous opening and positioning relative to these two directions. A through aperture in the plastic casing is not touched by the projectile opener. The problem of wear in connection with conventional positioning on the plastic casing therefor disappears. A projectile made of abrasion-resistant impact-resistant plastic facilitates oil-free operation and ensures very high cloth quality.

15 Claims, 3 Drawing Sheets

GRIPPER PROJECTILE

This invention relates to a gripper projectile. More particularly, this invention relates to a gripper projectile for a loom.

Heretofore, various types of projectiles made of plastic as well as steel have been known for use in looms and weaving machines. Generally, these projectile have been formed of an elongated casing and a clip mounted within the casing. In addition, the clip usually has a pair of arms on which two jaws are resiliently biased towards each other to grip a yarn.

As compared with steel projectiles, which are still the most widely used, the lower weight of plastic projectiles theoretically improves picking performance. However, the lower mechanical strength of the plastic parts used leads to new problems related to strength, wear, length of working life and service intervals. In this connection, there is a particularly severe problem in connection with the opening and centering of the projectile at yarn transfer. That is, the projectile clip must be spread open by a projectile opener transversely to the picking direction and located accurately along the picking direction for yarn transfer as, otherwise, mispicks may occur. The required result has conventionally been achieved by a metal projectile opener which passes through a bore in the casing to spread the metal projectile clip open transversely to the picking direction. At the same time, the bore functions as a centering bore to center the clip in the picking direction by means of the opener flanks striking the bore and, thus, positioning the projectile in the picking direction. This principle has been used both for steel projectiles and for projectiles having plastic casings. However, plastic casings experience heavy wear and distortions in the zones of engagement with the centering bore. As a result, positioning is impaired and mispicks are bound to occur. Further, the expenditure on service is substantial and the working lives of plastic projectiles are unsatisfactorily short, particularly at high loom speeds.

It is also known that if the finished cloth is to be of high quality, not a single oil spot must reach the cloth during wearing. When a metal projectile opener has to open the metal projectile clip, a minimal oil lubrication is essential. However, it is difficult and expensive to meter the lubrication accurately and to prevent traces of oil from reaching the cloth. Endeavours are therefore made to do without oil.

Accordingly, it is an object of this invention to solve the problems mentioned and to provide a plastics projectile with an associated opener and positioning device which can provide higher picking rates, cloth of high quality and highly reliable operation and which needs reduced servicing.

It is another object of the invention to provide a plastic projectile with an associated opener which can provide for higher picking rates.

It is another object to the invention to provide a plastic gripper projectile which permits cloth of high quality to be woven.

It is another object to the invention to reduce the servicing requirements of a loom employing gripper projectiles.

It is another object to the invention to provide a projectile which can be used in a highly reliable manner.

Briefly, the invention provides a gripper projectile which is comprised of a elongated plastic casing and a projectile clip. The casing is constructed with an aperture which passes transversely therethrough for passage of a projectile opener therethrough. The clip is disposed in a casing and has a pair arms disposed to opposite sides of the aperture in the casing.

In accordance with the invention, each arm of the projectile clip has an arcuate part disposed in the plane of the aperture of the casing which corresponds to an arcuate surface of the opener. When in use, the opener exerts forces transversely and longitudinally on the arcuate parts of the clip arms for simultaneous opening and positioning of the arms relative to a picking line of the gripper projectile.

The arcuate parts of the clip arms are arranged for movement between a closed position within the plane of the casing aperture and an open position within the plane of the aperture with a projectile opener therebetween. To this end, the aperture is of size greater than the cross-section of the opener in the open position of the arcuate parts. Thus, when an opener is in the open position of the clip arms, the opener does not come into contact with the casing.

In one embodiment, the arcuate parts of clip arms are in the form of circular segments, for example with each segment defining an opening angle of at least ninety degrees. In addition, each arcuate part may be rounded in a transverse direction relative to the casing for abutting against the flanks of the opener.

The use of circular segments provides a symmetrical, relationship while also permitting simple production of the projectile clip.

The use of an opening angle of at least ninety degrees permits a distribution of the pressure between the opener and clip arms evenly over a relatively large area during opening and centering. In this case, the arcuate parts may be adapted to the corresponding inner and outer flanks of the opener in the direction of opener movement, that is, perpendicular to the picking direction.

The projectile opener may be made of abrasion resistant impact-resistant plastic and can provide oil-free operation. This can not be achieved with an conventional centering bore in a plastic casing because of the disadvantageous frictional relationship which then occurs between plastic and plastic.

These and other objects and advantages of the invention will become more apparent from the following detailed description taken in conjunction with the accompanying drawings wherein.

Figure 3:
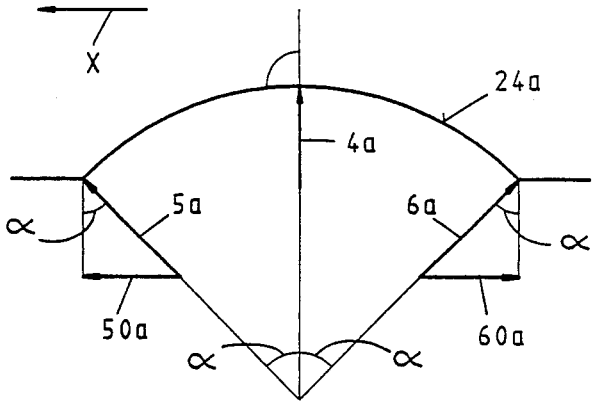
Figure 4A:
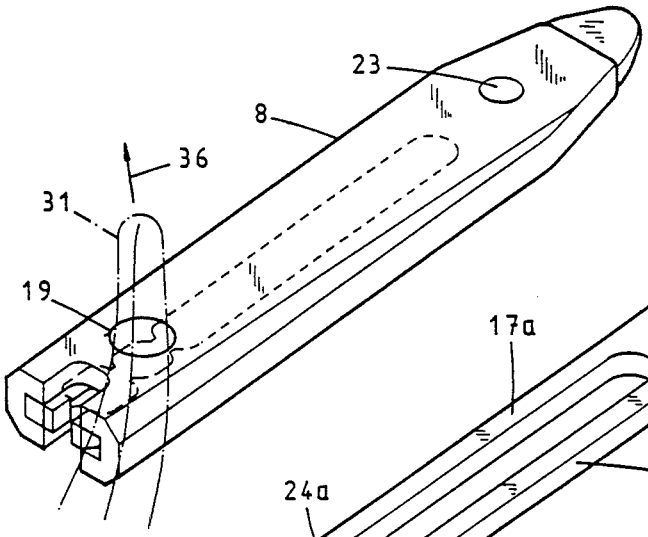
Figure 4B:
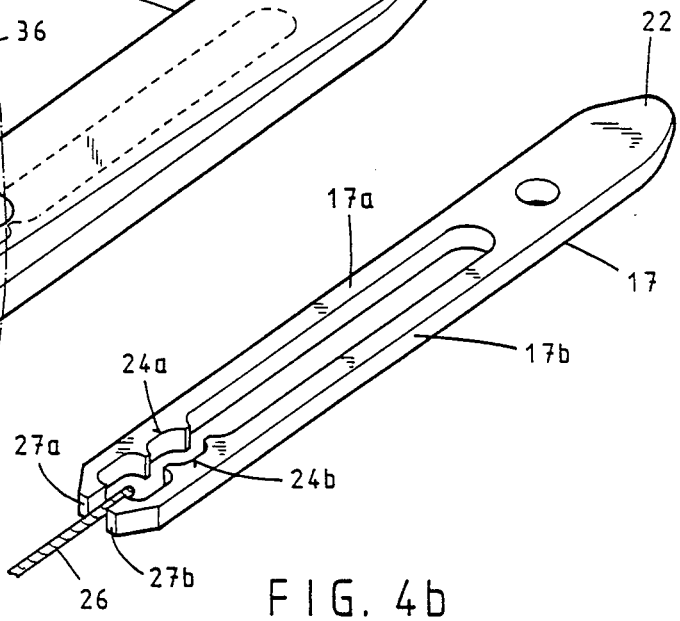
Figure 5C:
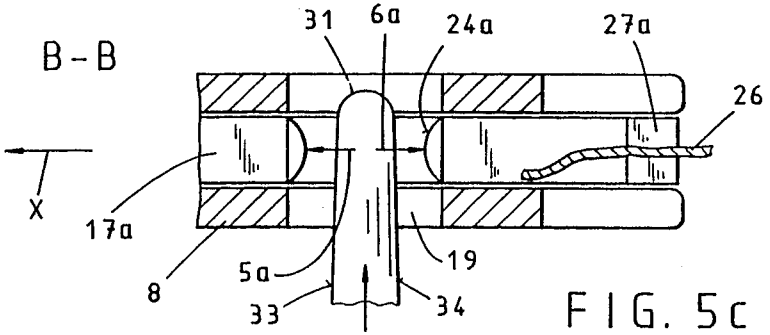
Figure 5A:
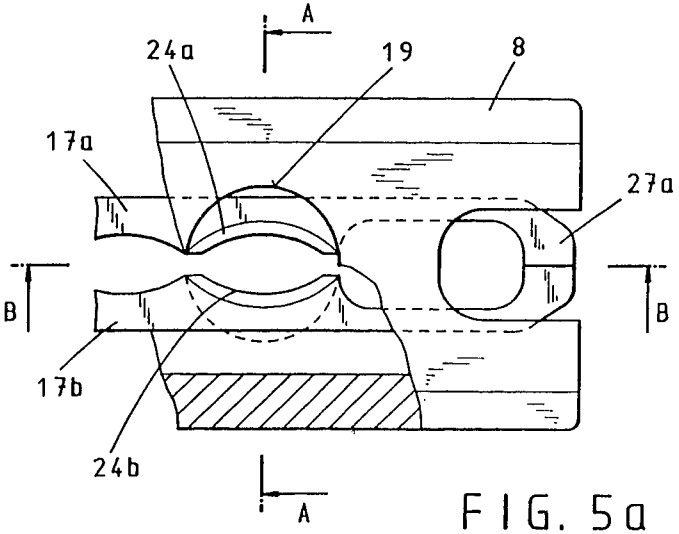
Figure 5B:
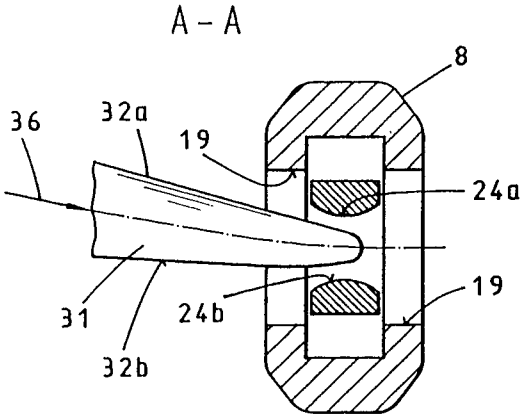

FIG. 3 diagrammatically illustrates the application of forces between a gripper opener and a arcuate part of a projectile clip constructed in accordance with the invention;

FIG. 4*a* illustrates a gripper projectile constructed in accordance with the invention;

FIG. 4*b* illustrates a perspective view of a projectile clip constructed in accordance with the invention;

FIG. 5*a* illustrates a rear end of a projectile constructed in accordance with the invention; FIG. 5*b* illustrates a view taken on line A—A of FIG. 5*a;* and FIG. 5c illustrates a view taken on line B—B of FIG. 5a.

Figure 1:
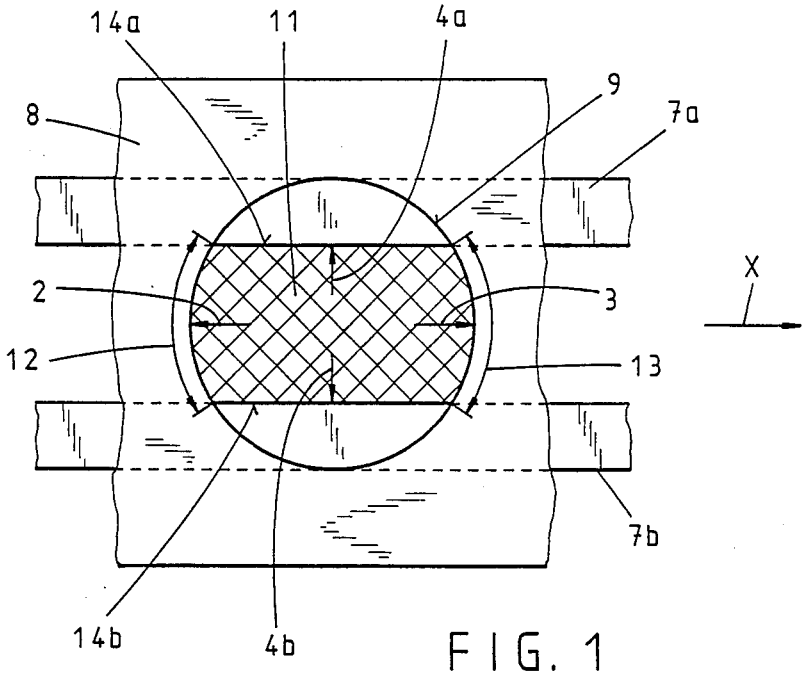
FIG. 1 illustrates a part of a conventional gripper projectile with an opener and centering function.

Referring to FIG. 1, a conventional gripper projectile includes, for example, a plastic casing 8 with a centering bore 9 and a projectile clip having a pair of arms 7a, 7b. During an opening and centering step, a projectile opener (not shown) passes through a variable region 11 bounded by contact surfaces 14a, 14b of the arms 7a, 7b and segments 12, 13 of the bore 9.

During the opening of the clip, the opener first exerts forces 4a, 4b on the arms 7a, 7b. As the opening movement proceeds further, the opener runs up onto the segments 12, 13 and exerts forces 2, 3 on the casing 8 in order to position the projectile.

Figure 2:
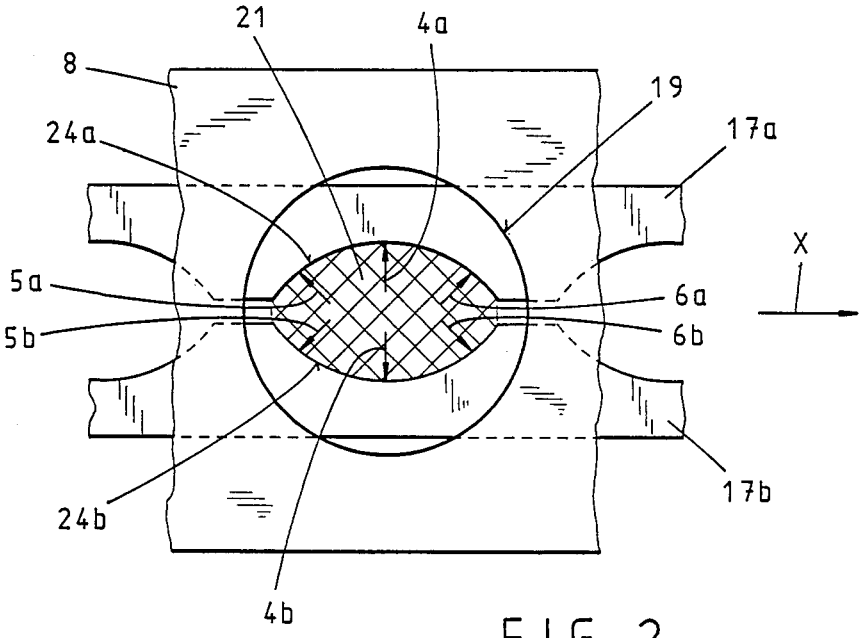
FIG. 2 illustrates a part of a gripper projectile constructed in accordance with the invention with an opener and centering function.

Referring to FIG. 2, in the gripper projectile constructed in accordance with the invention, no forces are exerted on the relatively delicate plastic casing 8.

As indicated in FIGS. 2 and 4a, the gripper projectile has an elongated plastic casing 8 having a pair of spaced parallel walls each of which has a opening aligned with the other to define an aperture 19 for passage of an opener 31 (FIG. 4a) therethrough. In addition, the projectile includes a projectile clip 17 which is mounted and secured within the casing 8 between the walls via a rivet 23. As indicated in FIG. 4b, the clip 17 has a pair of resilient arms 17a, 17b which are disposed to opposite sides of the aperture 19 of the casing 8. In addition, each arm 17a, 17b has a arcuate part 24a, 24b disposed in the plane of the aperture 19 (FIG. 5a). As well as a pair of jaws 27a, 27b for gripping a weft yarn 26 therebetween. As is known, the clip 17 also has a nose 22 which projects from a forward end of the casing 8 as well as a bore through which the rivet 23 or the like is passed to secure the clip 17 to the casing 8.

As indicated in FIG. 4a, the opener 31 is disposed so as to move through the aperture 19 of the casing 8 in a direction indicated by the arrow 36.

Referring to FIG. 2, each arcuate part 24a, 24b corresponds to an arcuate surface, i.e. the inner and outer flanks 33, 34, of the opener 31. In addition, each arcuate part 24a, 24b is disposed in the plane of the aperture 19 at all times when moving between a closed position for clamping on a weft yarn 26 (See FIG. 4) and an open position whereas the opener 31 has been fully inserted to spread apart the arms 17a, 17b for release of the weft yarn. Of note, when the arms 17a, 17b are in the open position, the opener 31 does not contact the casing 8 at any point about the aperture 19.

During actuation, the opener 31 engages only over a zone 21 bounded solely by the arcuate parts 24a, 24b of the clip arms 17a, 17b. Thus, the opener 31 exerts not only transverse forces 4a, 4b, i.e. forces which act transverse to the picking direction, but also forces 5a, 5b; 6a, 6b which act with vectors in the picking path X.

Referring to FIG. 3, the forces acting on the arcuate part 24a of the clip arms 17a are shown diagrammatically for the arcuate part having a circular segment and an opening angle $2\alpha$, advantageously of greater than ninety degrees. Thus, the force components 50a, 60a in the positive and negative picking direction X can be correspondingly large, i.e. proportional to $\sin \alpha$.

Referring to FIG. 4a, during use, the opener 31 moves in the direction indicated by the arrow 36 so as to strike the clip parts 24a, 24b, thus, opening the clip 17 so as to release the yarn 26 supplied by a yarn delivery device (not shown). In addition, the opener 31 retains the projectile for yarn transfer by way of the arcuate parts 24a, 24b exactly in the required optimal position.

Referring to FIG. 5a, 5b and 5c, the opening and centering function of the arcuate parts 24a, 24b and the projectile opener are shown more accurately from different sides.

As indicated, the arcuate parts 24a, 24b are rounded in a transverse direction relative to the casing 8 and perpendicularly to the picking path X. As indicated in FIG. 5b, the opener 31 has side flanks 32a, 32b which strike the arcuate parts 24a, 24b in the moving direction 36 whereas, as indicated in FIG. 5c, the inner flank 33 and outer flank 34 of the opener 31 contact both arcuate parts 24a, 24b.

As indicated particularly in FIG. 2, the aperture 19 in a casing 8 is of circular shape and is of a size greater than the cross-section of the opener 31 when the opener is in the open position of the arcuate parts 24a, 24b. Thus, the aperture 19 has no other function than to simply permit access of the opener 31 to the arcuate segments 24a, 24b of the clip. The aperture 19, therefore, does not need to be accurately shaped and positioned. Also, the area and, particularly, the wall thickness of the casing 8 may be reduced in the vicinity of the aperture 19. Corresponding, more space then becomes available for optimal dimensioning of the clip 17 and the other parts of the projectile.

Advantageously, the projectile opener 31 is made of abrasion-resistent impact-resistant plastic so that oil-free operation is possible. Likewise, the clip 17 may be made of metal while the casing 8 is made of a plastic suitable for picking.

Because of the improved positioning of the gripper via the projectile opener, the clearance between the projectile and a striker before launching may be reduced. This further reduces impacting and wear of the plastic casing during launching (picking) and thus improves efficiency with respect to this function as well. Further, not only can cloth quality and loom reliability be improved but also the working life can be increase several-fold.

What is claimed is:

1. A gripper projectile comprising an elongated plastic casing having an aperture passing transversely therethrough for passage of a projectile opener therethrough; and a projectile clip disposed in said casing and having a pair of arms disposed to opposite sides of said aperture, each said arm having an arcuate part disposed in the plane of said aperture and corresponding to an arcuate surface of the opener whereby the opener exerts forces transversely and longitudinally on said acurate parts for simultaneous opening and positioning of said arms without contacting said casing about said aperture.

2. A gripper shuttle as set forth in claim 1 wherein each arcuate part is in the form of a circular segment.

3. A gripper shuttle as set forth in claim 2 wherein each circular segment defines an opening angle of at least 90°.

4. A gripper shuttle as set forth in claim 1 wherein each arcuate part is rounded in a transverse direction relative to said casing.

5. A gripper projectile comprising an elongated plastic casing having a pair of spaced parallel walls, each said wall having an opening aligned with the opening of the other wall to define an aperture for passage of an opener therethrough; and a projectile clip mounted in and secured to said casing between said walls, said clip having a pair of resilient arms disposed on opposite sides of said aperture, each said arm having an arcuate part disposed in the plane of said aperture and corresponding to an arcuate surface of the opener whereby the opener exerts forces transversely and longitudinally on said acurate parts for simultaneous opening and positioning of said arms without contacting said casing about said aperture.

6. A gripper shuttle as set forth in claim 5 wherein each arcuate part is disposed on a circular arc.

7. A gripper shuttle as set forth in claim 6 wherein each arcuate part is disposed on a circular arc of at least 90°.

8. A gripper shuttle as set forth in claim 5 wherein each arcuate part is rounded in a transverse direction relative to said casing.

9. A gripper shuttle as set forth in claim 5 wherein each opening is circular.

10. A gripper shuttle as set forth in claim 5 wherein said clip is made of metal.

11. In combination a projectile opener; and a gripper projectile having a casing including an aperture for passage of said opener therethrough and a projectile clip disposed in said casing and having a pair of arms disposed to opposite sides of said aperture, each said arm having an arcuate part in the plane of said aperture and on opposite sides of said opener, said arcuate part corresponding to an arcuate surface of said opener for movement between a closed portion within said plane of said aperture and an open position within said plane with said opener therebetween.

12. The combination as set forth in claim 11 wherein said aperture is circular.

13. The combination as set forth in claim 11 wherein said aperture is of a size greater than the cross-section of said opener in said open position of said arcuate parts.

14. The combination as set forth in claim 11 wherein said opener is made of an abrasion-resistant and impact-resistant plastic.

15. The combination as set forth in claim 11 wherein said opener has a pair of opposed arcuate side surfaces of circular shape for imposing longitudinal and transverse forces on said arms to simultaneously open said arms and center said arms relative to said casing.

* * * * *

UNITED STATES PATENT AND TRADEMARK OFFICE

CERTIFICATE OF CORRECTION

PATENT NO. : 4,846,232

DATED : July 11, 1989

INVENTOR(S) : ERWIN PFARRWALLER

It is certified that error appears in the above-identified patent and that said Letters Patent is hereby corrected as shown below:

In the Abstract, line 9 "therefor" should be -therefore-
Column 2, line 2 change "a" to -an-
Column 3, line 20 change "a" to -an-
Column 3, line 28 change "a" to -an-
Column 2, line 6 after "pair" insert -of-
Column 2, line 45 change "an" to --a--
Column 4, line 23 change "Corresponding" to -Correspondingly-
Column 5, line 8 change "acurate" to -arcuate-

Signed and Sealed this

Eighth Day of October, 1991

*Attest:*

HARRY F. MANBECK, JR.

*Attesting Officer*

*Commissioner of Patents and Trademarks*